US009601046B2

(12) United States Patent
Kim

(10) Patent No.: US 9,601,046 B2
(45) Date of Patent: Mar. 21, 2017

(54) BRIGHTNESS CORRECTING SYSTEM AND METHOD OF CORRECTING BRIGHTNESS

(75) Inventor: Min-Cheol Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 818 days.

(21) Appl. No.: 13/569,535

(22) Filed: Aug. 8, 2012

(65) Prior Publication Data

US 2013/0249930 A1 Sep. 26, 2013

(30) Foreign Application Priority Data

Mar. 20, 2012 (KR) ..... 10-2012-0028349

(51) Int. Cl.

*G09G 3/30* (2006.01)
*G09G 3/3233* (2016.01)
*G09G 3/3225* (2016.01)

(52) U.S. Cl.

CPC ..... *G09G 3/30* (2013.01); *G09G 3/3233* (2013.01); *G09G 3/3225* (2013.01); *G09G 2320/029* (2013.01); *G09G 2320/0285* (2013.01); *G09G 2360/145* (2013.01); *G09G 2360/16* (2013.01)

(58) Field of Classification Search

CPC ..... G09G 2360/16; G09G 2320/0646; G09G 2320/0285; G06T 5/009; G06T 5/40

See application file for complete search history.

(56) References Cited

U.S. PATENT DOCUMENTS

2006/0092183 A1* 5/2006 Malmberg ..... 345/690
2006/0214940 A1* 9/2006 Kinoshita ..... G09G 3/2096 345/589
2007/0013647 A1 1/2007 Lee et al.
2007/0071318 A1* 3/2007 Yamashita et al. ..... 382/169
2007/0188623 A1* 8/2007 Yamashita et al. ..... 348/222.1
2008/0055210 A1* 3/2008 Cok ..... G09G 3/006 345/77
2009/0085926 A1 4/2009 Kim et al.
2009/0179849 A1* 7/2009 Wu et al. ..... 345/102

(Continued)

FOREIGN PATENT DOCUMENTS

KR 10-2003-0088539 A 11/2003
KR 10-2007-0013647 A 1/2007

(Continued)

*Primary Examiner* — William Boddie
*Assistant Examiner* — Bryan Earles
(74) *Attorney, Agent, or Firm* — Lewis Roca Rothgerber Christie LLP

(57) ABSTRACT

A brightness correcting system and a method of correcting brightness are provided. The brightness correcting system includes a display unit divided into a plurality of sample regions, a brightness measuring unit for measuring brightness values in the sample regions, a controller for selecting a reference pixel from among representative pixels respectively included in the sample regions, an offset value calculating unit for calculating offset values corresponding to respective differences between the brightness value of the reference pixel and the brightness values of the representative pixels, and for linearly calculating offset values of remaining pixels using the offset values of the representative pixels, and a data correcting unit for correcting the image data using the offset values of the pixels and supplying the corrected image data to the data driver.

12 Claims, 3 Drawing Sheets

(56) References Cited

U.S. PATENT DOCUMENTS

| | | | | |
|---|---|---|---|---|
| 2010/0253706 | A1* | 10/2010 | Shirouzu | 345/690 |
| 2011/0013834 | A1* | 1/2011 | Hsu | 382/168 |
| 2012/0169792 | A1* | 7/2012 | Yamashita et al. | 345/690 |

FOREIGN PATENT DOCUMENTS

| | | | |
|---|---|---|---|
| KR | 10-2009-0033759 | A | 4/2009 |
| KR | 10-2011-0052227 | A | 5/2011 |

* cited by examiner

BRIGHTNESS CORRECTING SYSTEM AND METHOD OF CORRECTING BRIGHTNESS

CROSS-REFERENCE TO RELATED APPLICATION

This application claims priority to and the benefit of Korean Patent Application No. 10-2012-0028349, filed on Mar. 20, 2012, in the Korean Intellectual Property Office, the entire content of which is incorporated herein by reference.

BACKGROUND

1. Field

Aspects of the present invention relate to a brightness correcting system and a method of correcting brightness, and more particularly, to a brightness correcting system capable of improving uniformity.

2. Description of the Related Art

Recently, various flat panel displays (FPDs) capable of reducing weight and volume as compared to cathode ray tubes (CRT) have been developed. The FPDs include liquid crystal displays (LCDs), field emission displays (FEDs), plasma display panels (PDPs), and organic light emitting displays.

Among the FPDs, the organic light emitting display displays images using organic light emitting diodes (OLED) that generate light by re-combination of electrons and holes. The organic light emitting display has high response speed and is driven with low power consumption.

However, variation in brightness is generated among pixels due to deviation in the characteristics of the OLEDs and deviation in manufacturing processes so that picture quality deteriorates.

SUMMARY

Accordingly, embodiments of the present invention are directed to a brightness correcting system capable of reducing the variation in the brightness components of pixels to improve uniformity in the brightness components and to improve picture quality, and a method of correcting brightness.

In one embodiment of the present invention, there is provided a brightness correcting system including a display unit including a plurality of pixels configured to emit light with brightness components corresponding to supplied image data, the display unit divided into a plurality of sample regions, a brightness measuring unit for measuring brightness values in the sample regions, a data driver for supplying the image data to the pixels, a controller for selecting a reference pixel among representative pixels of the plurality of pixels, the representative pixels respectively included in the sample regions, an offset value calculating unit for calculating offset values corresponding to respective differences between the brightness value of the reference pixel and the brightness values of the representative pixels, and for linearly calculating offset values of remaining pixels of the pixels using the offset values of the representative pixels, and a data correcting unit for correcting the image data using the offset values of the pixels and supplying the corrected image data to the data driver.

The controller may be configured to supply the same image data to the pixels to emit light, to set the brightness values of the sample regions that are measured by the brightness measuring unit as the brightness values of the representative pixels included in the corresponding sample regions, and to set the representative pixel having the smallest brightness value among the representative pixels as the reference pixel.

The representative pixels may be respectively positioned in the centers of the sample regions.

The brightness measuring unit may be configured to measure the brightness values of the sample regions based on the representative pixels respectively included in the sample regions.

The offset value calculating unit may be configured to form a look-up table including the offset values calculated for the pixels including the representative pixels and to store the look-up table in a memory.

Each of the pixels may include an organic light emitting diode (OLED).

In another embodiment of the present invention, a method of correcting brightness includes selecting a reference pixel among representative pixels respectively located in a plurality of sample regions of a display unit, calculating offset values corresponding to respective differences between a brightness value of the reference pixel and brightness values of the representative pixels, linearly calculating offset values of remaining pixels using the offset values of the representative pixels, and correcting image data using the offset values of the pixels and supplying the corrected image data to the pixels.

The selecting the reference pixel may include dividing the display unit into a plurality of sample regions each including one of the representative pixels, supplying the same image data to the pixels to emit light and measuring the brightness values of the sample regions, setting the measured brightness values of the sample regions as the respective brightness values of the representative pixels included in the corresponding sample regions, and setting a representative pixel having the smallest brightness value among the representative pixels as the reference pixel.

The representative pixels may be positioned in the centers of the sample regions, respectively.

In measuring the brightness values of the sample regions, the respective brightness values of the sample regions may be measured based on the representative pixels included in the sample regions.

The calculating the offset values of the representative pixels may include forming a look-up table of the offset values calculated for the pixels including the representative pixels.

The pixel may include an OLED.

As described above, according to embodiments of the present invention, it is possible to provide a brightness correcting system capable of reducing variation in the brightness components of pixels to improve uniformity in the brightness components and to improve picture quality, and a method of correcting brightness.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
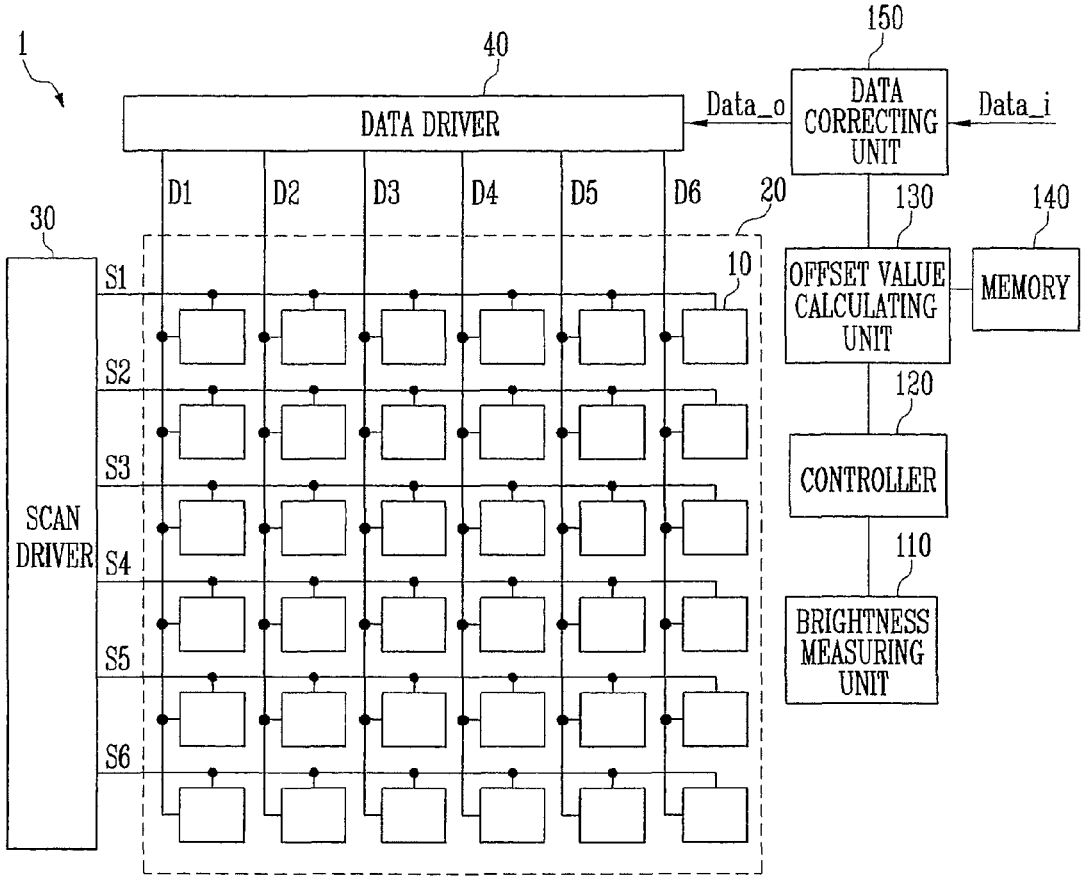
FIG. 1 is a block diagram illustrating a brightness correcting system according to an embodiment of the present invention.

Hereinafter, certain exemplary embodiments according to the present invention will be described with reference to the accompanying drawings. Here, when a first element is described as being coupled to a second element, the first element may be directly coupled to the second element or indirectly coupled to the second element via a third element. Further, some of the elements that are not essential to the complete understanding of the invention are omitted for clarity. Also, like reference numerals refer to like elements throughout.

The embodiments are described in the detailed description and drawings.

The aspects and characteristics of the present invention and a method of achieving the aspects and characteristics of the present invention now will be described more fully with reference to the accompanying drawings, in which exemplary embodiments of the invention are shown. This invention may, however, be embodied in many different forms and should not be construed as being limited to the embodiments set forth herein. In the drawings, when a part is coupled to another part, the part may be directly coupled to another part, and the part may be electrically coupled to another part with another element interposed. In the drawings, the part that is not related to the present invention is omitted for clarity of description. The same reference numerals in different drawings represent the same element, and thus their description will be omitted.

Hereinafter, a brightness correcting system and a method of correcting brightness will be described with reference to embodiments of the present invention and the drawings for describing the embodiments of the present invention.

FIG. 1 is a block diagram illustrating a brightness correcting system according to an embodiment of the present invention.

Referring to FIG. 1, a brightness correcting system 1 according to the embodiment of the present invention includes a display unit 20, a scan driver 30, a data driver 40, a brightness measuring unit 110, a controller 120, an offset value calculating unit 130, and a data correcting unit 150.

The display unit 20 includes a plurality of pixels 10 coupled to scan lines S1 to S6 and data lines D1 to D6, and is divided into a plurality of sample regions each including a set or predetermined number of pixels 10.

In FIG. 1, the display unit 20 including thirty-six pixels 10 is illustrated as an embodiment. However, the number of pixels 10 included in the display unit 20 may vary so that the number of scan lines and the number of data lines may vary accordingly. For example, a display unit according to embodiments of the present invention have hundreds of thousands of pixels.

The scan driver 30 generates scan signals and supplies the generated scan signals to the pixels 10 through the scan lines S1 to S6.

The data driver 40 aligns image data Data_o received from the data correcting unit 150 to supply the aligned image data Data_o to the pixels 10 through the data lines D1 to D6.

The image data Data_o are supplied to the pixels 10 selected by receiving the scan signals through the scan lines S1 to S6 so that the pixels 10 emit light components with the brightness components corresponding to the supplied image data Data_o.

Figure 2:
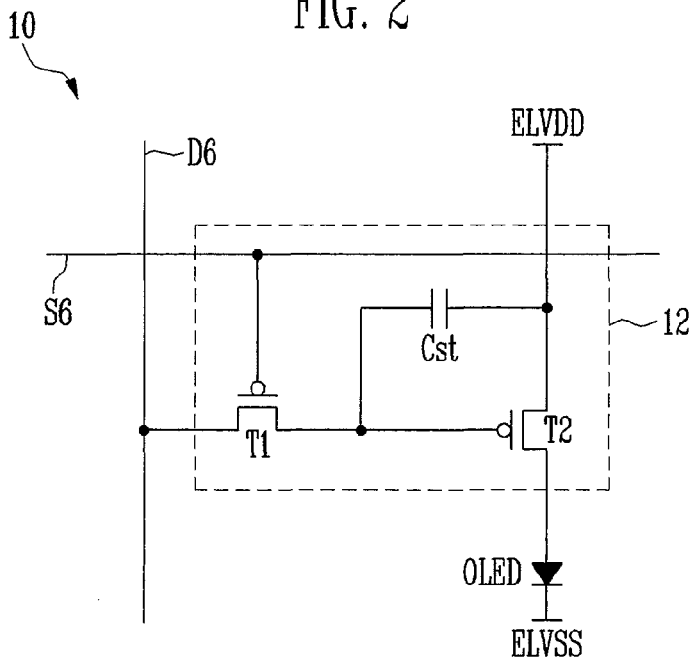
FIG. 2 is a schematic diagram illustrating an embodiment of a pixel of FIG. 1.

FIG. 2 is a schematic diagram illustrating an embodiment of the pixel 10 of FIG. 1. In particular, in FIG. 2, for convenience sake, the pixel 10 coupled to the sixth scan line S6 and the sixth data line D6 is illustrated.

Referring to FIG. 2, each of the pixels 10 includes an organic light emitting diode (OLED) and a pixel circuit 12, which is coupled to the data line (e.g., D6) and the scan line (e.g., S6) to control the OLED.

The anode electrode of the OLED is coupled to the pixel circuit 12, and the cathode electrode of the OLED is coupled to a second power source ELVSS.

The OLED generates light of a set or predetermined brightness to correspond to a current supplied from the pixel circuit 12.

In FIG. 2, the pixel circuit 12 controls the amount of current supplied to the OLED to correspond to the image data Data_o supplied to the data line D6 when a scan signal is supplied to the scan line S6. In this embodiment, the pixel circuit 12 includes a second transistor T2 coupled between a first power source ELVDD and the OLED, a first transistor T1 coupled among the second transistor T2, the data line D6, and the scan line S6, and a storage capacitor Cst coupled between the gate electrode of the second transistor T2 and the first electrode of the second transistor T2.

The gate electrode of the first transistor T1 is coupled to the scan line S6, and the first electrode of the first transistor T1 is coupled to the data line D6. The second electrode of the first transistor T1 is coupled to one terminal of the storage capacitor Cst. The first electrode is set as a source electrode or a drain electrode, and the second electrode is set as an electrode different from the first electrode. For example, when the first electrode is set as the source electrode, the second electrode is set as the drain electrode.

The first transistor T1 coupled to the scan line S6 and the data line D6 is turned on, when the scan signal (e.g., a low level signal) is supplied from the scan line S6, to supply the image data Data_o supplied from the data line D6 to the storage capacitor Cst. At this time, the storage capacitor Cst is charged with the voltage corresponding to the image data Data_o.

The gate electrode of the second transistor T2 is coupled to one terminal of the storage capacitor Cst, and the first electrode of the second transistor T2 is coupled to both the other terminal of the storage capacitor Cst and the first power source ELVDD. The second electrode of the second transistor T2 is coupled to the anode electrode of the OLED.

The second transistor T2 controls the amount of current that flows from the first power source ELVDD to the second power source ELVSS via the OLED to correspond to the voltage value stored in the storage capacitor Cst. At this time, the OLED generates light corresponding to the amount of current supplied from the second transistor T2.

Since the above-described pixel structure of FIG. 2 is one embodiment of the present invention, the pixel 10 according to the present invention is not limited to the above pixel structure.

Figure 3:
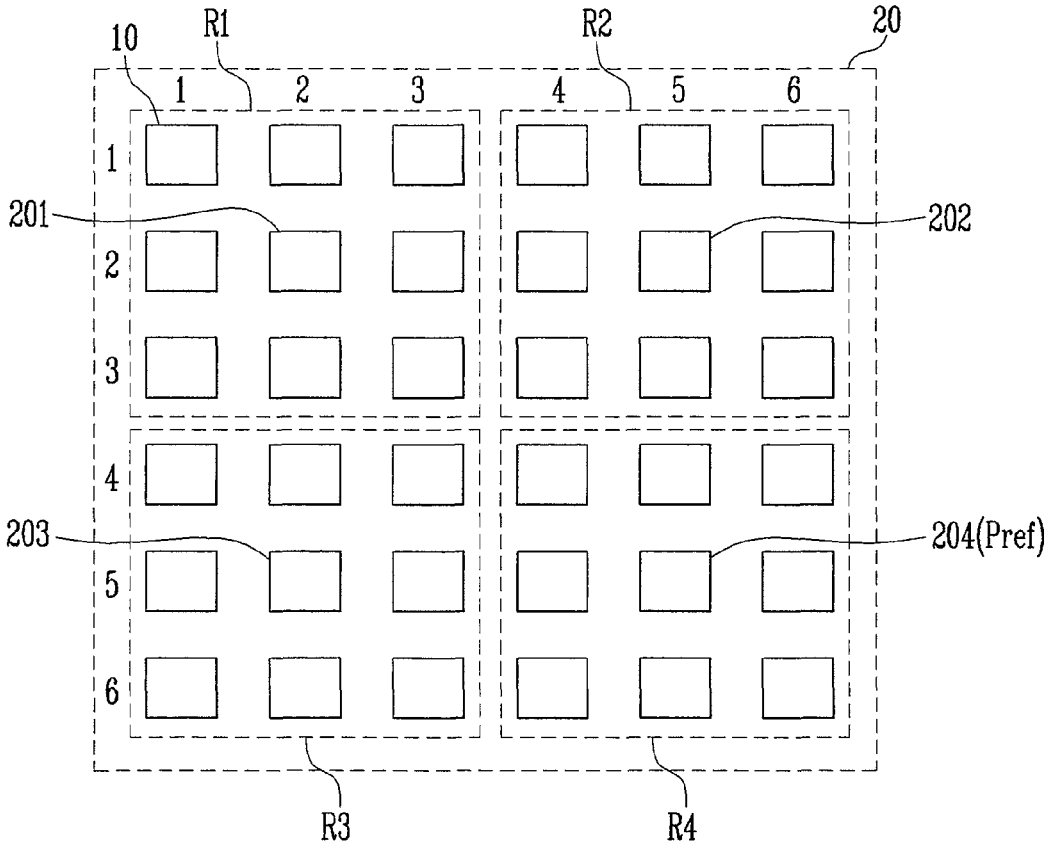
FIG. 3 is a drawing illustrating a display unit according to an embodiment of the present invention.

FIG. 3 is a drawing illustrating a display unit according to an embodiment of the present invention.

Referring to FIG. 3, the display unit 20 is divided into a plurality of sample regions R1, R2, R3, and R4.

In FIG. 3, the display unit 20 is divided so that each of the sample regions R1, R2, R3, and R4 includes nine pixels 10. However, the number of pixels 10 included in the sample regions R1, R2, R3, and R4 may vary.

In addition, in FIG. 3, the display unit 20 is divided into the four sample regions (the first sample region R1, the second sample region R2, the third sample region R3, and the fourth sample region R4). However, the number of sample regions may vary.

Representative pixels 201, 202, 203, and 204 that respectively represent the sample regions R1, R2, R3, and R4 are included in the sample regions R1, R2, R3, and R4, respectively.

Referring to FIG. 3, for example, the first representative pixel 201 is included in the first sample region R1, the second representative pixel 202 is included in the second sample region R2, the third representative pixel 203 is included in the third sample region R3, and the fourth representative pixel 204 is included in the fourth sample region R4.

In FIG. 3, the representative pixels 201, 202, 203, and 204 are set as the pixels positioned in the centers of the sample regions R1, R2, R3, and R4, respectively.

The above-described sample regions R1, R2, R3, and R4 and representative pixels 201, 202, 203, and 204 are set or controlled by the controller 120.

The brightness measuring unit 110 measures brightness components in the sample regions R1, R2, R3, and R4 of the display unit 20 and calculates brightness values that represent the measured brightness components.

At this time, the controller 120 supplies information on the sample regions R1, R2, R3, and R4 and information on the representative pixels 201, 202, 203, and 204 to the brightness measuring unit 110 to control the brightness measuring operation of the brightness measuring unit 110.

Accordingly, the brightness measuring unit 110 measures the brightness values of the sample regions R1, R2, R3, and R4 based on the representative pixels 201, 202, 203, and 204 respectively included in the sample regions R1, R2, R3, and R4 with reference to the information supplied from the controller 120.

In addition, the controller 120 selects a reference pixel Pref based on which an offset value is calculated from the plurality of representative pixels 201, 202, 203, and 204.

In order to select the reference pixel Pref, the controller 120 controls the data driver 40 to supply the same image data Data_o to the pixels 10.

The pixels 10 emit light in accordance with the received image data Data_o. However, although the same image data Data_o is received, due to deviation in the characteristics of the light emitting elements (e.g., the OLEDs) included in the pixels 10 and deviation in the manufacturing processes, the brightness components of the pixels 10 may be different from each other.

At this time, the brightness measuring unit 110 measures the brightness values of the sample regions R1, R2, R3, and R4 by the control of the controller 120.

Then, the controller 120 sets the brightness values of the sample regions R1, R2, R3, and R4 measured by the brightness measuring unit 110 as the brightness values of the representative pixels 201, 202, 203, and 204 included in the corresponding sample regions R1, R2, R3, and R4 to select the representative pixel having the smallest brightness value among the representative pixels 201, 202, 203, and 204 as the reference pixel Pref.

In FIG. 3, the brightness value of the fourth representative pixel 204 included in the fourth sample region R4 among the four representative pixels 201, 202, 203, and 204 is smallest so that the fourth representative pixel 204 is selected as the reference pixel Pref.

The offset value calculating unit 130 calculates the offset values of the representative pixels 201, 202, 203, and 204. The offset values are calculated as the differences between the brightness values of the representative pixels 201, 202, 203, and 204 and the brightness value of the reference pixel Pref.

That is, the offset value of the first representative pixel 201 is set as a difference between the brightness value of the first representative pixel 201 and the brightness value of the reference pixel Pref. The offset value of the second representative pixel 202 is set as a difference between the brightness value of the second representative pixel 202 and the brightness value of the reference pixel Pref. The offset value of the third representative pixel 203 is set as a difference between the brightness value of the third representative pixel 203 and the brightness value of the reference pixel Pref.

In addition, the offset value of the fourth representative pixel 204 is set as a difference between the brightness value of the fourth representative pixel 204 and the brightness value of the reference pixel Pref. However, since the fourth representative pixel 204 is the reference pixel Pref, the offset value of the fourth representative pixel 204 is 0.

In addition, the offset value calculating unit 130 linearly calculates the offset values of the remaining pixels 10 excluding the representative pixels 201, 202, 203, and 204 using the calculated offset values of the representative pixels 201, 202, 203, and 204.

At this time, the offset value calculating unit 130 forms a look-up table of the offset values calculated in the pixels 10 including the representative pixels 201, 202, 203, and 204 and stores the look-up table in a memory 140.

The data correcting unit 150 corrects the image data Data_i supplied from the outside using the offset values calculated for the pixels, and supplies the corrected image data Data_o to the data driver 40.

That is, the data correcting unit 150 corrects the image data Data_i supplied from the outside using the offset values that reflect the variation in the brightness components of the pixels 10 to improve uniformity in brightness.

At this time, the data correcting unit 150 corrects the image data Data_i with reference to the look-up table stored in the memory 140.

The data driver 40 that receives the corrected image data Data_o from the data correcting unit 150, supplies the image data Data_o to the pixels 10 through the data lines D1 to D6.

Figure 4:
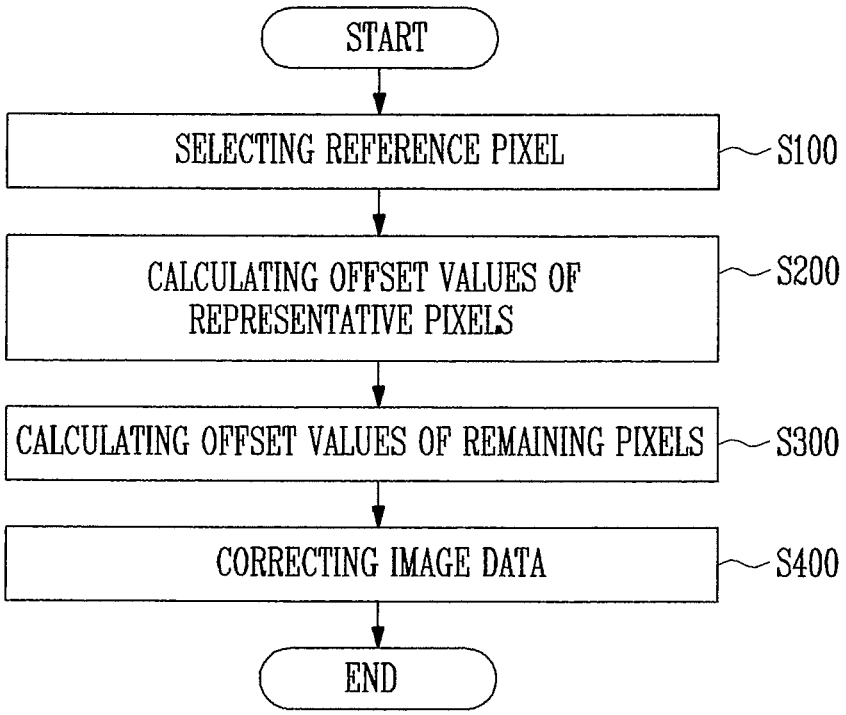
FIG. 4 is a flowchart illustrating a method of correcting brightness according to an embodiment of the present invention.

FIG. 4 is a flowchart illustrating a method of correcting brightness according to an embodiment of the present invention.

Referring to FIG. 4, the method of correcting brightness includes a step of selecting a reference pixel (S100), a step of calculating offset values of representative pixels (S200), a step of calculating offset values of the remaining pixels (S300), and a step of correcting image data (S400).

In the step of selecting the reference pixel (S100), the reference pixel (e.g., Pref of FIG. 3) is selected from the representative pixels (e.g., pixels 201, 202, 203, and 204 of FIG. 3) that exist in a plurality of sample regions (e.g., regions R1, R2, R3, and R4 of the display unit 20).

For example, in the step of selecting the reference pixel (S100), first, the display unit 20 is divided into the plurality of sample regions R1, R2, R3, and R4 including the representative pixels 201, 202, 203, and 204, respectively.

The same image data is supplied to all of the pixels 10 that exist in the display unit 20 so that the pixels 10 emit light components, and the brightness values of the sample regions R1, R2, R3, and R4 are measured.

In addition, the measured brightness values of the sample regions R1, R2, R3, and R4 are set as the brightness values of the representative pixels 201, 202, 203, and 204 included in the corresponding sample regions R1, R2, R3, and R4.

For example, when the brightness value of the first sample region R1 is measured as 16, the brightness value of the second sample region R2 is measured as 22, the brightness value of the third sample region R3 is measured as 19, and the brightness value of the fourth sample region R4 is measured as 10, the brightness value of the first representative pixel 201 is set as 16, the brightness value of the second representative pixel 202 is set as 22, the brightness value of the third representative pixel 203 is set as 19, and the brightness value of the fourth representative pixel 204 is set as 10.

At this time, in order to enhance the representativeness of the representative pixels 201, 202, 203, and 204 for the corresponding sample regions R1, R2, R3, and R4, the brightness components of the sample regions R1, R2, R3, and R4 are measured based on the representative pixels 201, 202, 203, and 204 respectively included in the sample regions R1, R2, R3, and R4.

At this time, the representative pixel having the smallest brightness value among the representative pixels 201, 202, 203, and 204 is set as the reference pixel Pref.

Therefore, in the above-described example, the fourth representative pixel 204 is set as the reference pixel Pref.

In the step of calculating the offset values of the representative pixels (S200), the offset values calculated by the differences between the brightness value of the reference pixel Pref and the brightness values of the representative pixels 201, 202, 203, and 204 are calculated for the representative pixels 201, 202, 203, and 204.

Therefore, in the above-described example, the offset value of the first representative pixel 201 is calculated as 6, the offset value of the second representative pixel 202 is calculated as 12, and the offset value of the third representative pixel 203 is calculated as 9. Since the fourth representative pixel 204 is the reference pixel Pref, the offset value of the fourth representative pixel 204 is calculated as 0.

In the step of calculating the offset values of the remaining pixels (S300), the offset values of the remaining pixels excluding the representative pixels 201, 202, 203, and 204 may be linearly calculated using the offset values of the representative pixels 201, 202, 203, and 204 calculated in the step of calculating the offset values of the representative pixels (S200).

For example, in the second row to which the first representative pixel 201 and the second representative pixel 202 belong, since the offset value of the first representative pixel 201 and the offset value of the second representative pixel 202 are 6 and 12, the pixel (3, 2) and the pixel (4, 2) positioned between the first representative pixel 201 and the second representative pixel 202 may have the offset values of 8 and 10. In addition, the pixel (1, 2) and the pixel (6, 2) may have the offset values of 4 and 14.

In addition, in the fifth row to which the third representative pixel 203 and the fourth representative pixel 204 belong, since the offset value of the third representative pixel 203 and the offset value of the fourth representative pixel 204 are 9 and 0, the pixel (3, 5) and the pixel (4, 5) positioned between the third representative pixel 203 and the fourth representative pixel 204 may have the offset values of 6 and 3. In addition, the pixel (1, 5) and the pixel (6, 5) may have the offset values of 12 and −3.

Since the offset values of the pixels positioned in the second row and the fifth row are calculated, the offset values of the pixels positioned in first to sixth columns may be calculated based on the offset values of the pixels positioned in the second row and the fifth row.

For example, in the second column, since the offset value of the pixel (2, 2) and the offset value of the pixel (2, 5) are 6 and 9, the pixel (2, 3) and the pixel (2, 4) positioned between the pixel (2, 2) and the pixel (2, 5) may have the offset values of 7 and 8. In addition, the pixel (2, 1) and the pixel (2, 6) may have the offset values of 5 and 10.

In such a method, the offset values of the pixels positioned in the remaining columns are calculated.

In the step of correcting the image data (S400), after the image data Data_i supplied from the outside are corrected using the offset values of the pixels that are calculated in the step of calculating the offset values of the representative pixels (S200) and the step of calculating the offset values of the remaining pixels (S300), the corrected image data Data_o are supplied to the pixels 10.

For example, the pixel (2, 2) has the offset value of 6. When the image data supplied to the pixel (2, 2) is corrected to be subtracted by the offset value of 6, the pixel (2, 2) has substantially the same brightness characteristic as the reference pixel Pref having the offset value of 0.

In addition, the pixel (6, 5) has the offset value of −3. When the image data supplied to the pixel (6, 5) is corrected to be increased by the offset value of 3, the pixel (6, 5) has substantially the same brightness characteristic as the reference pixel Pref having the offset value of 0.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A brightness correcting system, comprising:

a display unit comprising a plurality of pixels configured to emit light with brightness components corresponding to supplied image data, the display unit being divided into a plurality of sample regions, each of the plurality of sample regions having one representative pixel selected from among a plurality of pixels;

a brightness measuring unit for measuring brightness values in the sample regions;

a data driver for supplying the image data to the pixels;

a controller configured to select one reference pixel from among the plurality of representative pixels of the plurality of sample regions;

an offset value calculating unit for calculating offset values corresponding to respective differences between the brightness value of the one reference pixel and the brightness values of the representative pixels corresponding to the sample regions, and for linearly calculating offset values of remaining pixels of the pixels using the offset values of the representative pixels such that a difference between the offset values of a pair of adjacent ones of the pixels in a row or column of the pixels that comprises the representative pixels of adjacent ones of the sample regions is the same as a difference between the offset values of another pair of adjacent ones of the pixels in the row or column; and a data correcting unit for correcting the image data using the offset values of the pixels and supplying the corrected image data to the data driver, wherein the controller is configured to supply the same image data to the pixels to emit light, to set the brightness values of the sample regions that are measured by the brightness measuring unit as the brightness values of the representative pixels included in the corresponding sample regions, and to set the representative pixel having the smallest brightness value among the representative pixels as the one reference pixel.

2. The brightness correcting system as claimed in claim 1, wherein the brightness measuring unit is configured to measure the brightness values of the sample regions based on the representative pixels respectively included in the sample regions.

3. The brightness correcting system as claimed in claim 1, wherein the representative pixels are respectively positioned at centers of the sample regions.

4. The brightness correcting system as claimed in claim 1, wherein the offset value calculating unit is configured to form a look-up table including the offset values calculated for the pixels including the representative pixels, and to store the look-up table in a memory.

5. The brightness correcting system as claimed in claim 1, wherein each of the pixels comprises an organic light emitting diode (OLED).

6. A method of correcting brightness, comprising:

selecting one reference pixel among representative pixels respectively located at a plurality of sample regions of a display unit, each of the plurality of sample regions having one representative pixel selected from among a plurality of pixels;

calculating offset values corresponding to respective differences between a brightness value of the one reference pixel and brightness values of the plurality of representative pixels corresponding to the sample regions;

linearly calculating offset values of remaining pixels using the offset values of the representative pixels such that a difference between the offset values of a pair of adjacent ones of the pixels in a row or column of the pixels that comprises the representative pixels of adjacent ones of the sample regions is the same as a difference between the offset values of another pair of adjacent ones of the pixels in the row or column; and correcting image data using the offset values of the pixels and supplying the corrected image data to the pixels, wherein the selecting the one reference pixel comprises:

dividing the display unit into the plurality of sample regions each including one of the representative pixels;

supplying the same image data to the pixels to emit light and measuring the brightness values of the sample regions;

setting the measured brightness values of the sample regions as the respective brightness values of the representative pixels included in the corresponding sample regions; and setting a representative pixel having the smallest brightness value among the representative pixels as the one reference pixel.

7. The method as claimed in claim 6, wherein, in measuring the brightness values of the sample regions, the respective brightness values of the sample regions are measured based on the representative pixels included in the sample regions.

8. The method as claimed in claim 6, wherein the representative pixels are positioned at the centers of the sample regions, respectively.

9. The method as claimed in claim 6, wherein the calculating the offset values of the representative pixels comprises forming a look-up table of the offset values calculated for the pixels including the representative pixels.

10. The method as claimed in claim 6, wherein each of the pixels comprises an OLED.

11. The brightness correcting system as claimed in claim 1, wherein the representative pixels in each of the sample regions is surrounded by the remaining pixels in the sample region.

12. The method as claimed in claim 6, wherein the representative pixels in each of the sample regions is surrounded by the remaining pixels in the sample region.

* * * * *